US007893621B2

(12) United States Patent
Schamiloglu et al.

(10) Patent No.: US 7,893,621 B2
(45) Date of Patent: Feb. 22, 2011

(54) EGGBEATER TRANSPARENT CATHODE FOR MAGNETRONS AND UBITRONS AND RELATED METHODS OF GENERATING HIGH POWER MICROWAVES

(75) Inventors: Edl Schamiloglu, Albuquerque, NM (US); Mikhail I. Fuks, Albuquerque, NM (US); Herman L. Bosman, Albuquerque, NM (US); Sarita Prasad, Albuquerque, NM (US)

(73) Assignee: STC.UNM, Albuquerque, NM (US)

( * ) Notice: Subject to any disclaimer, the term of this patent is extended or adjusted under 35 U.S.C. 154(b) by 597 days.

(21) Appl. No.: 12/019,140

(22) Filed: Jan. 24, 2008

(65) Prior Publication Data

US 2008/0246385 A1 Oct. 9, 2008

Related U.S. Application Data

(60) Provisional application No. 60/897,258, filed on Jan. 24, 2007.

(51) Int. Cl.
*H01J 25/50* (2006.01)

(52) U.S. Cl. ..... 315/39.51; 315/39.63; 315/39.77; 313/240; 313/247; 313/263; 219/678; 219/756

(58) Field of Classification Search ..... 315/39, 315/39.51, 39.63, 39.65, 39.75, 39.77; 313/240, 313/247, 252, 256, 263, 270, 326, 411; 219/678, 219/756, 758

See application file for complete search history.

(56) References Cited

U.S. PATENT DOCUMENTS 2,883,576 A * 4/1959 Harries ..... 313/257
3,274,432 A * 9/1966 Peterson ..... 315/39.63
6,538,386 B2 * 3/2003 Small ..... 315/39.51
6,872,929 B2 * 3/2005 Neculaes et al. ..... 219/761
7,696,696 B2 * 4/2010 Fuks et al. ..... 315/39.51

OTHER PUBLICATIONS

Schamiloglu et al., "*High Power Magnetrons and Ubitrons Driven by Transparent Cathodes*," research paper supported, in part, by a grant from AFOSR, Department of Electrical & Computer Engineering, University of New Mexico, Albuquerque, NM, Jul. 2006.

Fuks et al., "*Mode Conversion in a Magnetron With Axial Extraction of Radiation*," IEEE Transactions on Plasma Science, vol. 34, No. 3, Jun. 2006, pp. 620-626.

Bosman et al., "*Improvement of the Output Characteristics of Magnetrons Using the Transparent Cathode*," IEEE Transactions on Plasma Science, vol. 34, No. 3, Jun. 2006, pp. 606-616.

Fuks et al., "*Rapid Start of Oscillations in a Magnetron with a "Transparent" Cathode*," The American Physical Society, PRL, 95, pp. 205101, 4 pages, Nov. 11, 2005.

* cited by examiner

*Primary Examiner*—Haissa Philogene
(74) *Attorney, Agent, or Firm*—MH2 Technology Law Group LLP

(57) ABSTRACT

An "eggbeater" cathode comprising a transparent cathode including a plurality of longitudinally oriented cathode strips anchored at both ends between support discs and forming an open-walled hollow cylindrical structure. A cathode base is disposed substantially coaxially with a longitudinal axis of the transparent cathode and surrounded by the plurality of cathode strips, wherein the support discs secure the cathode strips to the cathode base and result in a cathode that is more robust in harsh operating environments compared with a simple transparent cathode.

20 Claims, 6 Drawing Sheets

EGGBEATER TRANSPARENT CATHODE FOR MAGNETRONS AND UBITRONS AND RELATED METHODS OF GENERATING HIGH POWER MICROWAVES

CROSS-REFERENCE TO RELATED APPLICATIONS

This application claims the benefits of priority of U.S. Provisional Application No. 60/897,258, filed on Jan. 24, 2007, which is incorporated by reference herein in its entirety.

STATEMENT REGARDING FEDERALLY SPONSORED RESEARCH OR DEVELOPMENT

This invention was made with Government support under Grant Nos. F496200110354 and FA 9950-05-1-0300, both awarded by the Air Force Office of Scientific Research (AFOSR). The Government has certain rights in the invention.

FIELD

The present invention relates generally to magnetrons and ubitrons, and, more particularly, to novel transparent cathodes for generating high power microwaves.

BACKGROUND

Recent work in the area of crossed-field devices has been directed to improving the output of high power microwave (HPM) sources. Crossed-field devices of particular interest include relativistic magnetrons and ubitrons. Further, improvement of the crossed-field devices has been through the use of conventional transparent cathodes. Generally speaking, a conventional transparent cathode consists of individual emitters periodically arranged about a fixed radius.

Magnetrons are widely used as powerful and compact sources for the generation of high power microwaves in a variety of applications. Such applications can include, but are not limited to, microwave ovens, telecommunications equipment, lighting applications, radar applications, and military and weapons applications, for example.

A typical conventional magnetron structure is a coaxial vacuum diode with a cathode having a solid cylindrical surface and an anode consisting of an even number of cavities forming an azimuthally periodical resonant system. In many designs, resonator cavities of various shapes are cut into the internal surface of the anode, for example, in a gear tooth pattern. During operation, a steady axial magnetic field fills the annular vacuum region between the cathode and anode, and a voltage is applied between them to provide conditions for microwave generation. TE-type eigenmodes of the resonant system are used as operating waves Two types of oscillations may be used, the $\pi$-mode (with opposite directions of electric field in neighbor cavities) and the $2\pi$-mode (with identical directions of electric field in all cavities). The frequency of the generated microwaves is based in part on the number and shape of the resonator cavities, and the design features of the anode and cathode.

A cross-sectional view of a conventional A6 magnetron modeled using "MAGIC" particle-in-cell (PIC) code is illustrated in FIG. 1. As shown, a conventional magnetron comprises an anode 10, a cathode 20, which is a solid cylindrical structure, and resonator cavities 15. In this example, a waveguide 40 is located in one of resonator cavities 15 in order to extract the generated microwaves. A dielectric can also be present to extract the generated microwaves. There are other ways known to those skilled in the art for extracting the microwaves as well, such as, for example, axially using diffraction output.

Electrons emitted from the cathode 20 form a solid flow drifting around cathode 20 with velocity determined by the applied voltage and magnetic field. When the azimuthal phase velocity of one of eigenmodes of the resonant system is close to the azimuthal drift velocity of the electrons, energy of electrons is transferred to this electromagnetic wave. As the wave gains energy, fields of the wave back-react on the electron charge cloud to produce spatial bunching of the electrons, which in turn reinforces the growth of the wave.

Magnetrons are either of the hot (thermionic) cathode type, which typically operate at voltages ranging from a few hundred volts to a few tens of kilovolts, or of the cold cathode type, with secondary electron emission or explosive emission, the latter of which are typically used in relativistic magnetrons, which operate at high voltage (hundreds kilovolts) and enable the generation of very high power microwaves.

As indicated, it is known that use of the transparent cathode can significantly enhance radiation characteristics of relativistic magnetrons. A conventional transparent cathode is depicted by way of example in each of FIG. 2 and FIG. 3, with each example including a discrete number of thin explosive electron emission regions arranged azimuthally at a fixed radius corresponding to the radius of a traditional solid cathode. This arrangement allows the azimuthal wave electric field to go to zero on-axis, as opposed to going to zero on the surface of the solid cathode. This provides both cathode and magnetic priming, in addition to providing a much stronger wave electric field in the sheath region.

As shown schematically in FIG. 2, the cathode 200 has a thin-walled cylindrical body 210 which includes a number of separate strip-shaped emitter regions 220 supported at one end of the thin-walled body 210 and open at the end of the emitter regions. The emitter regions 220 are consecutively disposed around a longitudinal axis of the cathode body 210 such that an imaginary envelope surface surrounding the emitter regions 220 forms a substantially hollow cylindrical structure. The emitter regions 220 are typically spaced relative to each other at intervals around the perimeter of the cathode body 210. Thus, empty regions (openings) 225 between consecutive (e.g., adjacent) emitter regions 220 are formed. The empty regions 225 permit the passage of electromagnetic field therethrough such that the field "penetrates" the cathode 200 up to the longitudinal axis of the cathode body 210. Accordingly, the cathode 200 is referred to as a "transparent" cathode.

As also shown in FIG. 2, the emitter regions 220 are longitudinally oriented and substantially parallel to one another. The number, azimuthal position with respect to anode resonant cavities and configuration of the emitter regions 220 can be selected so as to achieve certain operating characteristics of the magnetron.

FIG. 3 differs from FIG. 2 in depicting cylindrical rather than strip-shaped emitter regions. As shown schematically in FIG. 3, the cathode 300 has a thin-walled cylindrical body 310 which includes a number of separate emitter regions 320 supported at one end of the thin-walled body 310 and open at the distal end of the emitter regions. The emitter regions 320 are consecutively disposed around a longitudinal axis of the cathode body 310 as described in connection with FIG. 2. The emitter regions 320 are typically spaced relative to each other at intervals around the perimeter of the cathode body 310. Thus, empty regions (openings) 325 between consecutive (e.g., adjacent) emitter regions 320 are formed. The empty regions 325 permit the passage of electromagnetic field therethrough such that the field "penetrates" the cathode 300 up to the longitudinal axis of the cathode body 310.

As also shown in FIG. 3, the cylindrically shaped emitter regions 320 are longitudinally oriented and substantially parallel to one another. The number, azimuthal position with respect to anode resonant cavities and configuration of the emitter regions 320 can be selected so as to achieve certain operating characteristics of the magnetron.

Another crossed-field device, an ubitron (not shown), can also be used in connection with the transparent cathode of FIG. 2 or FIG. 3 for providing improved high power microwave output. The ubitron has been studied in both simulations and experiments. The ubitron is a simple device, including a transparent cathode in a pipe with an axial magnetic field. In the ubitron, the electron sheath flows through a periodic transverse magnetic field, similar to Bekefi's smooth-bore magnetron. Unlike Bekefi's device, however, the ubitron requires no external permanent magnets.

In either of the relativistic magnetron or ubitron, the emitter regions (cathode strips) of the conventional transparent cathode are supported at only a single end by the thin-walled cylindrical body, and can therefore deform over time. Deformation of the cathode strips can lead to a decrease in performance of the magnetron or ubitron. Further, when cathode strips are very long or thin, they can be unable to support their own weight over their length. In repetitive pulse or continuous wave type magnetrons, electron bombardment can heat up the cathode strips and further decrease their mechanical strength, particularly at their longer length or if the cathode strips are relatively thin. In magnetrons that operate at high currents, longitudinal currents flowing in the cathode strips and the magnetic forces between the cathode strips can also contribute to their deformation.

Although the known transparent cathode can provide advantages over the conventional solid cathode, they may not address many of the deficiencies and/or desirable features noted above. By way of example, and not limitation, the conventional approaches may not provide sufficient mechanical strength to the transparent cathode in the case of very long or thin cathode strips since the cathode strips are only supported at one end. Moreover, cathode strips of the known transparent cathode can experience warping since the strips are only supported on one end. The individual cathode strips can carry kilo-amperes of current that can induce severe ohmic heating of the metal, thereby degrading its mechanical integrity. Further, the currents in the individual cathodes also generate magnetic fields, and the forces due to these magnetic fields may warp the cylindrical profile of the cathode strips. These detrimental occurrences can be avoided with the disclosed novel transparent eggbeater cathode.

Thus, there is a need to overcome these and other problems of the prior art and to provide a transparent cathode for a magnetron, ubitron, or the like having fully supported cathode strips.

SUMMARY

Based on the various above-mentioned deficiencies of conventional transparent cathodes as used in magnetron and ubitron devices, it is desirable to improve upon conventional transparent cathode designs. For example, it can be desirable to provide a transparent cathode that can maintain structural and mechanical integrity of the transparent cathode, particularly the cathodes strips thereof at various lengths and diameters or thickness. As a further example, it can be desirable to provide a transparent cathode that can withstand heat from electron bombardment or can withstand deformation due to magnetic forces therebetween and current generated therein.

Further, it is also desirable to provide increased utility of the transparent cathode in an ubitron, thereby generating high power microwave radiation. This high power microwave source can operate as a coherent (single frequency) emitter, or as an emitter of dense spectrum (noise generator).

These features can be achieved by the exemplary embodiments of the invention described herein. To achieve these and other advantages, and in accordance with the present teachings, is a transparent cathode for use in a magnetron and an ubitron. More particularly, the transparent cathode can be termed an "eggbeater" cathode, thus distinguishing it from the conventional transparent cathode of FIG. 2 and FIG. 3.

The eggbeater cathode can include a plurality of longitudinally oriented cathode regions anchored at both ends between support discs and forming an open-walled hollow cylindrical structure.

In accordance with another exemplary embodiment is an eggbeater cathode for use in a magnetron.

The eggbeater type transparent cathode can include a plurality of longitudinally oriented emitter regions disposed around a longitudinal axis of the cathode, a support disc secured to opposing ends of the emitter regions, the support discs comprising an axial opening, and a cathode base disposed substantially coaxially with a longitudinal axis of the cathode through the axial opening of the support discs and surrounded by the plurality of emitter regions, wherein the support discs secure the emitter strips to the cathode base. Each emitter region can be configured to emit electrons, and adjacent emitter regions are separated from one another by openings.

In accordance with yet another exemplary embodiment is a relativistic magnetron.

The relativistic magnetron can include an anode body and a cathode body concentrically disposed within the anode body. The cathode body can include a cathode base disposed substantially coaxially with a longitudinal axis of the cathode body and surrounded by a. plurality of longitudinally oriented emitter regions, the emitter regions anchored at both ends between support discs, thereby forming a cylindrical structure, wherein each emitter region is configured to emit electrons, and wherein consecutive emitter regions are separated from one another by openings.

It is to be understood that both the foregoing general description and the following detailed description are exemplary and explanatory only and are not restrictive of the invention.

BRIEF DESCRIPTION OF THE DRAWINGS

The accompanying drawings, which are incorporated in and constitute a part of this specification, illustrate embodiments of the invention and together with the description, serve to explain certain principles. In the drawings.

DESCRIPTION OF EXEMPLARY EMBODIMENTS

Figure 1:
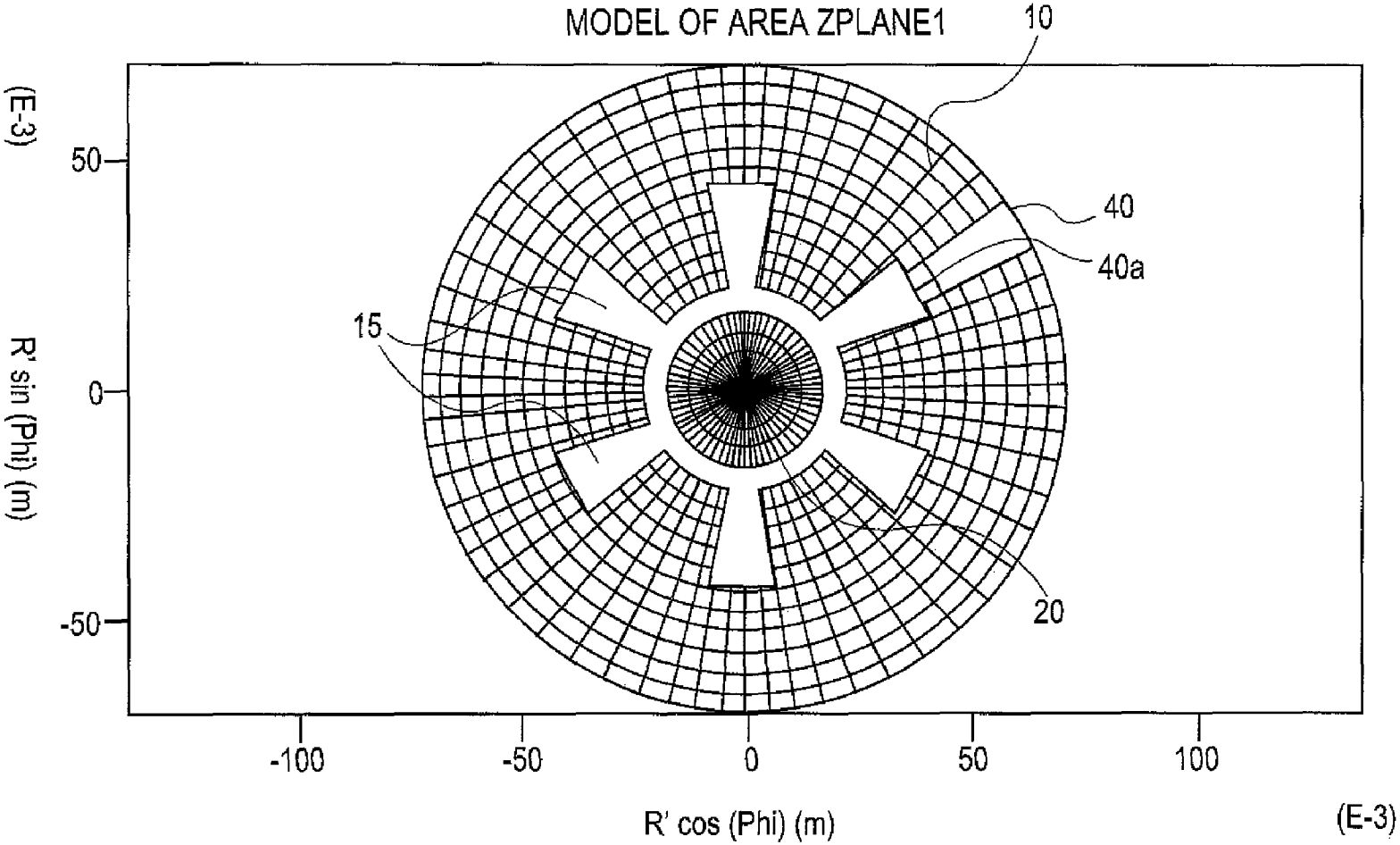
FIG. 1 (PRIOR ART)
FIG. 1 is a cross-sectional view of a simulation model of a conventional A6 magnetron.

To achieve some of the advantages and desirable features noted above, the embodiments of the present disclosure are directed to devices and methods that support cathode strips at both ends, rather than only at a single end as in the known transparent cathode. By supporting the cathode strips at both ends the devices and methods can prevent deformation of the cathode strips by maintaining mechanical integrity, and hence avoid a decrease in performance of the magnetron and ubitron. The resulting transparent cathode, with cathode strips supported at both ends, can be referred to as an "eggbeater" cathode. The increased mechanical support provided to both ends of cathode strips in the eggbeater cathode can be particularly beneficial when the cathode strips are very long, very thin, and/or otherwise unable to support their own weight. The eggbeater cathode can also be advantageous in repetitively pulsed or continuous wave magnetrons by supporting both ends of the cathode strips in the case where electron bombardment can heat up the cathode strips and further decrease their mechanical strength. Further, deformation of the conventional transparent cathode strips due to magnetic forces between and due to longitudinal currents flowing in the cathode strips can be eliminated in the transparent eggbeater cathode device supporting the cathode strips at both ends.

In accordance with various exemplary embodiments described herein, a magnetron having an eggbeater cathode can result in fields of TE-modes, which are used as operating waves in magnetrons, which penetrate through a virtual cylindrical surface at which discrete emitters are periodically spaced so as to reach the longitudinal axis of the magnetron. Because of this, the azimuthal electric field of the operating wave is relatively strong near the cathode surface providing rapid drift of electrons to the anode, along with rapid buildup of oscillations. The weak dependence of the value of the electric field in the electron flow on its thickness can result in an increase in magnetron efficiency and radiation power as the applied voltage and magnetic field are increased. A relativistic magnetron having an eggbeater cathode according to various exemplary embodiments can also operate with longer pulse because cathode plasma can propagate in all directions from individual emitters, thereby decreasing the plasma's density and velocity in the interaction space in comparison with a magnetron having an explosive emitting cathode with a solid surface in which the plasma propagates only in a direction toward the anode.

Further, a magnetron having an eggbeater cathode in accordance with various exemplary embodiments can give a strong initial impetus for favorable modulation of an electron flow by selecting a suitable number and position of the emitters (e.g., so as to achieve cathode priming). Longitudinal currents along the emitters produce magnetic fields around each emitter that form a periodical magnetic field. Thus, both cathode priming and magnetic priming can be achieved in magnetrons according to various embodiments.

Reference will now be made in detail to exemplary embodiments of the invention, which are illustrated in the accompanying drawings. Wherever possible, the same reference numbers will be used throughout the drawings to refer to the same or like parts.

Figure 4:
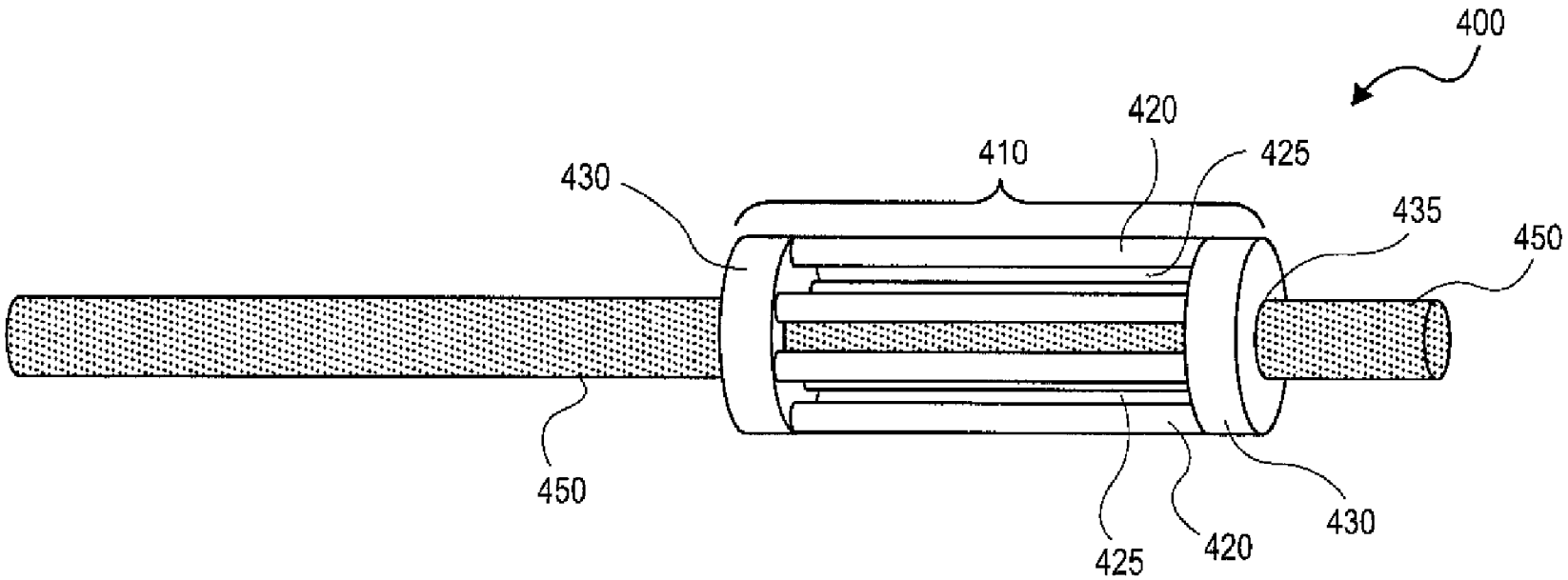
FIG. 4 is a perspective view of an exemplary transparent cathode according to an aspect of the disclosure.

An exemplary eggbeater transparent cathode is schematically illustrated in FIG. 4. As shown in FIG. 4, the eggbeater cathode 400 has a body 410 which includes a number of separate explosive emitter regions 420. The emitter regions can be referred to as cathode strips. The emitter regions 420 can be consecutively disposed around a longitudinal axis of the cathode body 410 such that an imaginary (virtual) envelope surface surrounding the emitter regions 420 forms a substantially hollow and open-walled cylindrical structure. In the exemplary embodiment shown in FIG. 4, the emitter regions 420 can be spaced from each other at substantially uniform intervals around the perimeter of the cathode body 410. Thus, empty regions (openings) 425 between consecutive (e.g., adjacent) emitter regions 420 are formed. The empty regions 425 permit the passage of electromagnetic field therethrough such that the field penetrates the cathode 400 therethrough and up to the longitudinal axis of the cathode body 410.

In order to provide support to the emitter regions 420, a support disc 430 can be provided at opposing longitudinal ends of the emitter regions 420. The support discs 430 can include an axial opening 435 formed therein and the emitter regions 420 can be formed adjacent an outer perimeter of each support disc 430. The emitter regions 420 can be fixed or otherwise mounted to the support discs 430 in a manner suitable to provide stationary support to the emitter regions 420 over the life of the eggbeater 400. By way of example, the support discs 430 can be connected to the emitter regions 420 by welding or the like.

Figure 2:
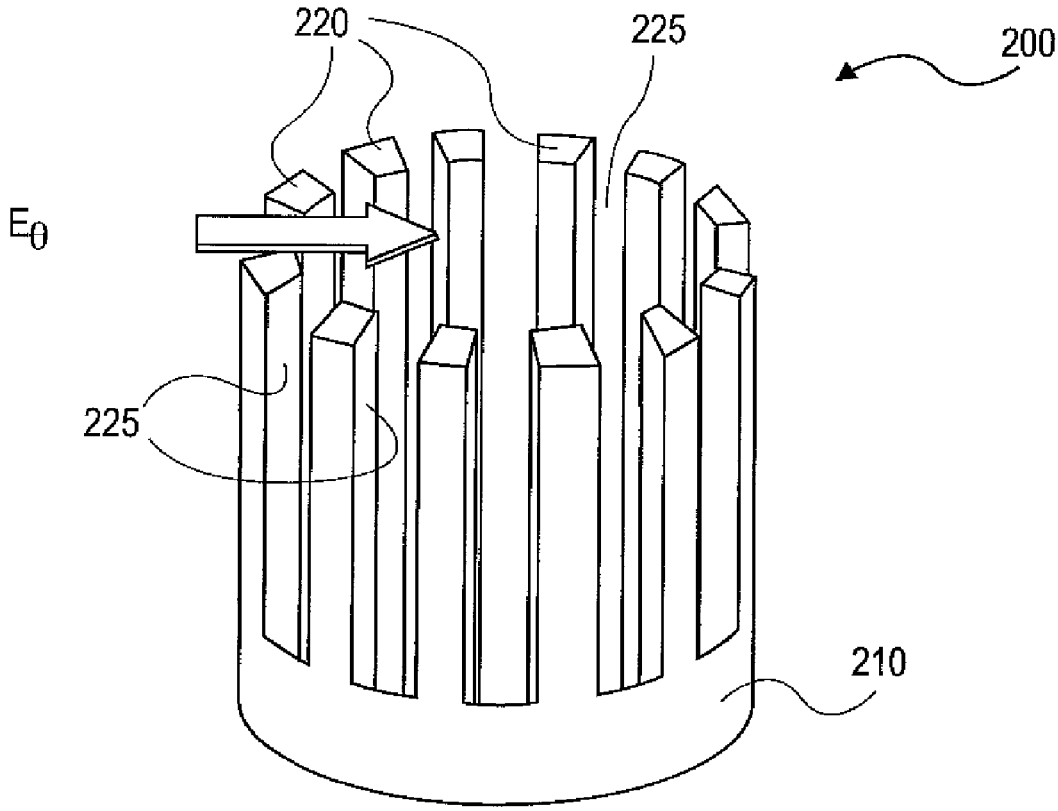
FIG. 2 (PRIOR ART)
FIG. 2 is a schematic perspective view of a conventional transparent cathode.
Figure 3:
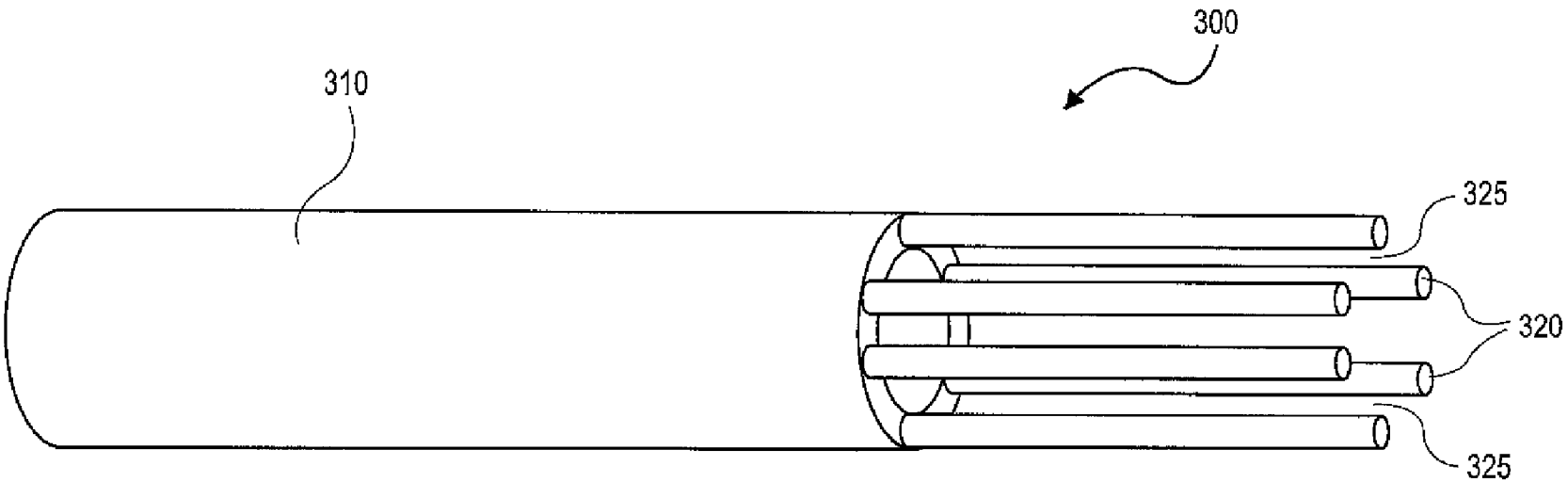
FIG. 3 (PRIOR ART)
FIG. 3 is a schematic perspective view of a conventional transparent cathode depicting an alternative emitter shape.

As also shown in the exemplary embodiment of FIG. 4, the emitter regions 420 can be longitudinally oriented and substantially parallel to one another. Further, the emitter regions 420 can be any suitable shape including substantially rectangular, substantially cylindrical, and substantially sectored (discrete) rods. An example of the rectangular shape can be found in FIG. 2 of the transparent cathode. Such a shape can be incorporated into the emitter regions 420 of the eggbeater cathode 400. The number, azimuthal position with respect to anode resonant cavities and configuration of the emitter regions 420 can be selected so as to achieve desirable operating characteristics of the magnetron.

According to the exemplary embodiment of FIG. 4, the eggbeater cathode 400 can further include a cathode base 450 in the form of a solid rod (e.g., a cylindrical rod) having a relatively small diameter disposed substantially coaxially with a longitudinal axis of the cathode 400 and such that it is surrounded by the number of emitter regions 420. More specifically, the solid rod 450 is inserted through the axial openings 435 of the support discs 430. In other words, the solid rod 450 can be disposed centrally of the hollow cylinder defined by the number of emitter regions 420. In some applications, such an inner rod 450, whether metal or dielectric, can provide additional advantages such as mechanical support and mechanical integrity.

Although the exemplary embodiment of FIG. 4 shows the eggbeater cathode 400 having a specific number of separated emitter regions 420, it should be understood that any number of emitter regions can be used and selected so as to achieve desired operation of the magnetron. To excite the desired operating wave, it may be desirable to select a number of emitters corresponding to a field symmetry of the wave so as to produce the pre-modulation of the electron flow, which is inherent to the excited wave. For example, to excite the $\pi$-type of oscillations in a magnetron with 6 cavities, it may be desirable to use 3 or 9 emitters, whereas an eggbeater cathode with 6 or 12 emitters can promote excitation of the $2\pi$-type of oscillations.

It is further envisioned in connection with the exemplary embodiments that the components of the eggbeater cathode 400 can be formed of metal, and the emitter regions 420 can be metal and can further comprise dielectric material. Exemplary metals can include stainless steel, tungsten, aluminum, etc.

Given the mechanical support provided by the support discs 430 to the emitter regions 420, it is expected that the emitter regions can be formed substantially longer and thinner than previously achieved. The eggbeater cathode can support longer lengths and thinner emitters. This may be of interest for lower frequency magnetrons where the dimensions get substantially larger. As an example, for X-band magnetrons a cathode length of about 3 cm might be sufficient, and for L-band magnetrons a cathode length of about 30 cm can be required.

Figure 5:
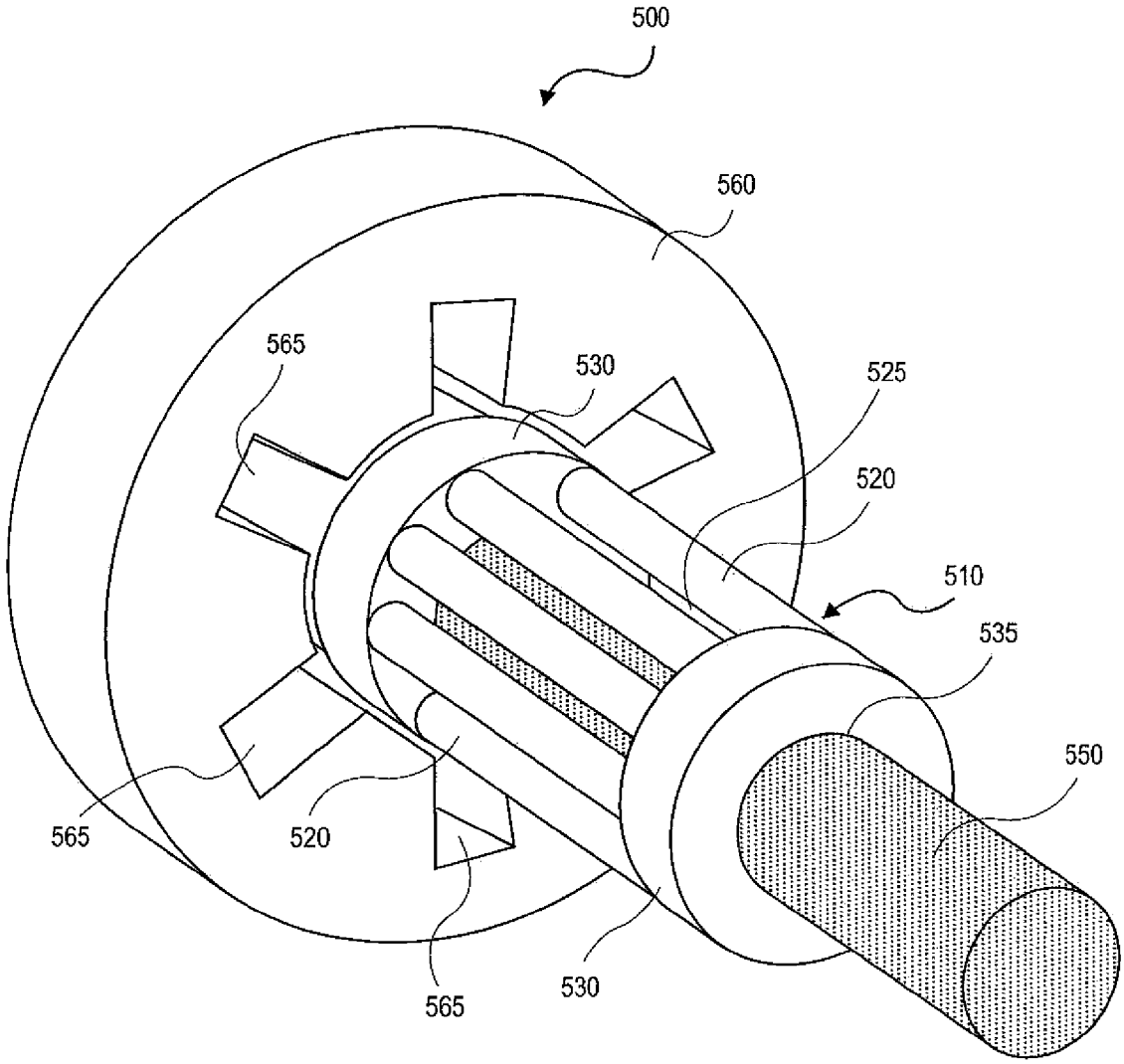
FIG. 5 is a schematic perspective view of a magnetron including the exemplary transparent cathode.

FIG. 5 illustrates a perspective view of another exemplary embodiment of a magnetron 500 according to an aspect of the disclosure. As shown in FIG. 5, the magnetron 500 can includes an eggbeater cathode 510 with six discrete emitter regions 520 uniformly spaced around a cathode base 550 and fixed between opposing support discs 530. The emitter regions 520 of FIG. 5 are in the form of longitudinally oriented, parallel cylinders. It will be appreciated that the emitter regions 520 can be substantially rectangular and can be substantially sectored rods as previously described. FIG. 5 further shows an anode 560 surrounding the cathode 510 in a concentric manner. The anode 560 includes six resonator cavities 565 and the emitter regions 520 can be disposed radially inward of the resonator cavities.

Figure 6:
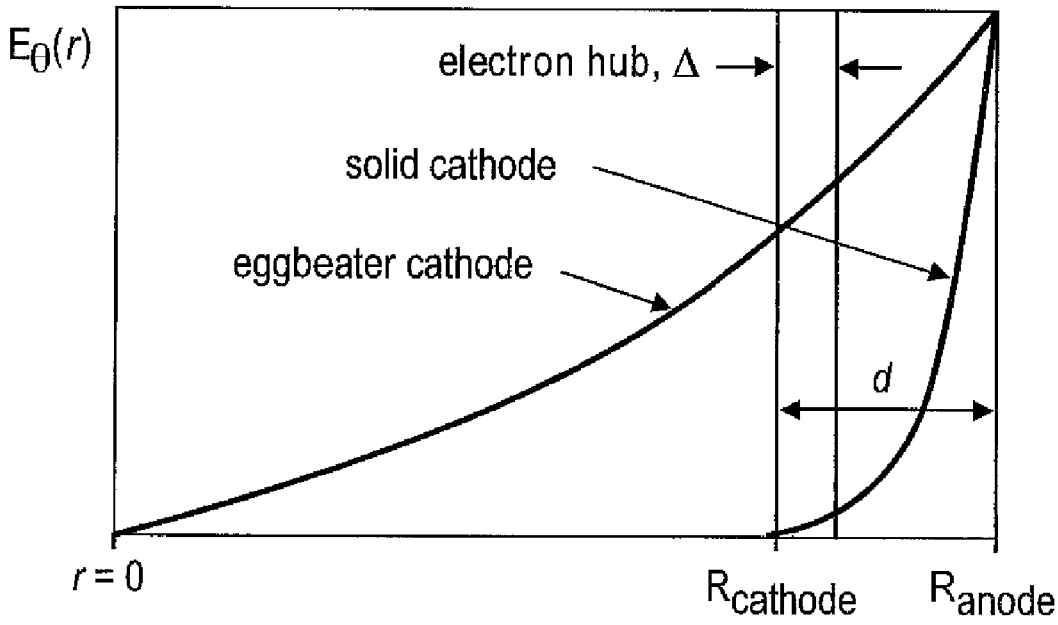
FIG. 6 is a graph depicting the dependence of the azimuthal RF electric field on the radial coordinate for a transparent and solid cathode, respectively.

It will be appreciated that the purpose of replacing the traditional solid cylindrical cathode with the eggbeater cathode having cathode strips is to render the cathode "transparent" to the azimuthal RF electric field. Referring to FIG. 6, the different field distributions for solid and transparent cathodes is compared. Since the $E_{\varnothing}$ field is responsible for the capturing electrons into spokes, and for moving the electrodes from the magnetically insulated electron hub to the anode, the transparent cathode of the eggbeater type will provide a faster startup of the magnetron due to the larger amplitude of the $E_{\varnothing}$ field in the electron hub region. It will be appreciated that the eggbeater cathode then extends the regimes of applicability of the transparent cathode (longer cathode emitters, thinner emitters, robustness to back bombardment, repetitive operation, etc.).

Results of simulation studies using magnetrons and ubitrons driven by transparent cathodes are reported in "High Power Magnetrons and Ubitrons Driven by Transparent Cathodes," presented July and September, 2006, which is incorporated by reference in its entirety herein. In the study presented in the paper, the solid cathode of a conventional A6 magnetron and an ubitron in the form of a rippled field magnetron were replaced with a transparent cathode comprising longitudinal emitter regions as described in connection with FIGS. 1 and 2. The results of this simulation study demonstrate, among other things, that using a transparent cathode in lieu of a solid cathode in the A6 magnetron or ubitron can significantly improve output characteristics of high powered microwaves. Such an opportunity can be further enhanced with a transparent cathode of the disclosed and novel eggbeater type.

Overall, the eggbeater cathode can maintain mechanical strength and avoid the degradation encountered by conventional transparent cathodes in which the thin wall of the cathode body supports the emitter regions at only one end thereof. Moreover, exemplary embodiments disclose emitters of greater length and smaller diameter being used without sacrificing the structure or function of the transparent cathode as described.

As discussed above, various applications for the magnetrons according to exemplary aspects of the invention are envisaged, including but not limited to, use as sources for microwave ovens, lighting applications, telecommunications applications, military applications, high-resolution radar systems, and other applications in which high power microwave sources may be desirable.

It should be noted that sizes and configurations of various structural parts and materials used to make the above-mentioned parts are illustrative and exemplary only. One of ordinary skill in the art would recognize that those sizes, configurations, and materials can be changed to produce different effects or desired characteristics. For example, the number, shape, size, and/or positioning of the cathode emitter regions can be altered as desired and various dimensions of the magnetron structures can also be changed so as to achieve desired output characteristics. Although some of the exemplary embodiments disclosed describe a conventional A6 magnetron, it should be understood that such is exemplary only and the various dimensions and configurations of the various parts of the magnetron can be altered in a manner so as to obtain desired operating characteristics. Further, it is envisioned that upon determining a desired operation of the magnetron, the number of discrete emitters, the azimuthal widths of each emitter, the azimuthal orientation with respect to the anode vanes, and/or other design configurations can be varied to reach an optimal solution. Moreover, although in some disclosed embodiments, the cathode emitter regions were illustrated as being symmetrically disposed, such symmetry is not required.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations thereof. Other embodiments of the invention will be apparent to those skilled in the art from consideration of the specification and practice of the invention disclosed herein.

All patents and publications referenced or mentioned herein are indicative of the levels of skill of those in the art to which the invention pertains, and each such referenced patent or publication is hereby incorporated by reference to the same extent as if it had been incorporated by reference in its entirety individually or set forth herein in its entirety. Applicants reserve the right to physically incorporate into this specification any and all materials and information from any such cited patents or publications.

The specific methods and compositions described herein are representative of preferred embodiments and are exemplary and not intended as limitations on the scope of the invention. Other objects, aspects, and embodiments will occur to those skilled in the art upon consideration of this specification, and are encompassed within the spirit of the invention as defined by the scope of the claims. It will be readily apparent to one skilled in the art that varying substitutions and modifications may be made to the embodiments disclosed herein without departing from the scope and spirit of the invention. The embodiments illustratively described herein suitably may be practiced in the absence of any element or elements, or limitation or limitations, which are not specifically disclosed herein as essential. The methods and processes illustratively described herein suitably may be practiced in differing orders of steps, and they are not necessarily restricted to the order of steps indicated herein or in the claims.

As used herein and in the appended claims, the singular forms "a", "an", and "the" include plural reference unless the context clearly dictates otherwise. Thus, for example, a reference to "emitter regions" includes a plurality of such emitter regions, and so forth. Under no circumstances may the patent be interpreted to be limited to the specific examples or embodiments or methods specifically disclosed herein. Under no circumstances may the patent be interpreted to be limited by any statement made by any Examiner or any other official or employee of the Patent and Trademark Office unless such statement is specifically and without qualification or reservation expressly adopted in a responsive writing by Applicants.

The terms and expressions that have been employed are used as terms of description and not of limitation, and there is no intent in the use of such terms and expressions to exclude any equivalent of the features shown and described or portions thereof, but it is recognized that various modifications are possible within the scope of the invention as claimed. Thus it will be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

The invention has been described broadly and generically herein. Each of the narrower species and subgeneric groupings falling within the generic disclosure also form part of the invention. This includes the generic description of the invention with a proviso or negative limitation removing any subject matter from the genus, regardless of whether or not the excised material is specifically recited herein.

In addition, where features or aspects of the invention are described in terms of Markush groups, those skilled in the art will recognize that the invention is also thereby described in terms of any individual member or subgroup of members of the Markush group.

What is claimed is:

1. A transparent cathode for use in a microwave generating device, the transparent cathode comprising:

a plurality of longitudinally oriented cathode strips anchored at both ends between support discs and forming an open-walled hollow cylindrical structure.

2. The transparent cathode of claim 1, further comprising a cathode base disposed substantially coaxially with a longitudinal axis of the transparent cathode and surrounded by the plurality of cathode strips.

3. The transparent cathode of claim 2, wherein the support discs secure the cathode strips to the cathode base.

4. The transparent cathode of claim 2, wherein a radius of the cathode base is less than an inner radius of the cathode strips.

5. The transparent cathode of claim 2, wherein the cathode base comprises a solid rod.

6. The transparent cathode of claim 5, wherein a radius of the solid rod is less than an inner radius of the cathode strips.

7. The transparent cathode of claim 5, wherein the solid rod is cylindrical.

8. The transparent cathode of claim 2, wherein the cathode base comprises metal.

9. The transparent cathode of claim 2, wherein the cathode base comprises a dielectric.

10. The transparent cathode of claim 1, wherein the cathode strips comprise metal.

11. The transparent cathode of claim 1, wherein each of the cathode strips has a strip-like configuration.

12. The transparent cathode of claim 1, wherein each of the cathode strips has a substantially cylindrical configuration.

13. The transparent cathode of claim 1, wherein the cathode has an overall length of about 30 cm.

14. A transparent cathode for use in a microwave generating device, the cathode comprising:

a plurality of longitudinally oriented emitter regions disposed around a longitudinal axis of the cathode;

a support disc secured to each of opposing ends of the emitter regions, the support discs comprising an axial opening; and a cathode base disposed substantially coaxially with a longitudinal axis of the cathode through the axial opening of the support disc and surrounded by the plurality of emitter regions, wherein the support discs secure the emitter regions to the cathode base;

wherein each emitter region is configured to emit electrons, and wherein adjacent emitter regions are separated from one another by openings.

15. The transparent cathode of claim 14, wherein a radius of the cathode base is less than an inner radius of the emitter regions.

16. The transparent cathode of claim 14, wherein the cathode base is cylindrical.

17. The transparent cathode of claim 14, wherein the openings are configured to permit an azimuthal electric field to pass between consecutive emitter regions and travel toward the longitudinal axis of the cathode.

18. The transparent cathode of claim 17, wherein the azimuthal electric field at the emitter regions is significantly greater than zero.

19. The transparent cathode of claim 14, wherein each of the emitter regions has any of a strip-like and substantially cylindrical configuration.

20. A relativistic magnetron, the magnetron comprising:

an anode body; and a cathode body concentrically disposed within the anode body, wherein the cathode body comprises a cathode base disposed substantially coaxially with a longitudinal axis of the cathode body and surrounded by a plurality of longitudinally oriented emitter regions, the emitter regions anchored at both ends between support discs, thereby forming a cylindrical structure, wherein each emitter region is configured to emit electrons, and wherein consecutive emitter regions are separated from one another by openings.

* * * * *